US010240748B2

(12) United States Patent
Dietz

(10) Patent No.: US 10,240,748 B2
(45) Date of Patent: Mar. 26, 2019

(54) VARIABLE MODULAR LIGHTING SYSTEM

(71) Applicant: Bernhard Dietz, Toronto (CA)

(72) Inventor: Bernhard Dietz, Toronto (CA)

( * ) Notice: Subject to any disclaimer, the term of this patent is extended or adjusted under 35 U.S.C. 154(b) by 129 days.

(21) Appl. No.: 15/346,201

(22) Filed: Nov. 8, 2016

(65) Prior Publication Data

US 2018/0128446 A1 May 10, 2018

(51) Int. Cl.

| | |
|---|---|
| ***F21V 1/06*** | (2006.01) |
| ***F21V 1/12*** | (2006.01) |
| ***F21V 1/14*** | (2006.01) |
| ***F21V 1/18*** | (2006.01) |
| ***F21V 1/22*** | (2006.01) |
| ***F21Y 115/10*** | (2016.01) |

(52) U.S. Cl.

CPC ..... *F21V 1/06* (2013.01); *F21V 1/12* (2013.01); *F21V 1/143* (2013.01); *F21V 1/18* (2013.01); *F21V 1/22* (2013.01); *F21Y 2115/10* (2016.08)

(58) Field of Classification Search

CPC ... F21V 1/06; F21V 1/12; F21V 1/143; F21V 17/007; B65D 5/20; B65D 5/48018

See application file for complete search history.

(56) References Cited

U.S. PATENT DOCUMENTS

| | | | | |
|---|---|---|---|---|
| 1,292,188 | A | 1/1919 | Wheeler | |
| 3,895,229 | A | 7/1975 | Strom | |
| D293,723 | S | 1/1988 | Buttner | |
| D311,337 | S * | 10/1990 | Rigby | D9/433 |
| 5,171,014 | A | 12/1992 | Hsieh | |
| 5,772,424 | A * | 6/1998 | Nokelainen | F21S 13/12 229/155 |
| 8,807,417 | B2 * | 8/2014 | Valesini Gegembauer | B65D 5/009 206/594 |
| 2009/0196050 | A1 | 8/2009 | Chiang | |
| 2010/0214779 | A1 | 8/2010 | Kao | |
| 2012/0087119 | A1 | 4/2012 | Chang | |
| 2015/0109799 | A1 | 4/2015 | Wu | |

* cited by examiner

*Primary Examiner* — Peggy A Neils
(74) *Attorney, Agent, or Firm* — Kramer Amado, P.C.

(57) ABSTRACT

Various embodiments relate to device including a hollow box, having a central rectangular cuboid with a first edge, second edge and a third edge and four faces, where the first, second and third edges are perpendicular and so define the cuboid in three dimensions, two opposed irregular triangular prism-shaped wings with each irregular triangular prism-shaped wing attached to a full first edge and a full second edge, and a fourth edge not touching the central rectangular cuboid.

13 Claims, 21 Drawing Sheets

VARIABLE MODULAR LIGHTING SYSTEM

TECHNICAL FIELD

This invention relates to lighting products that can be attached in a modular fashion to create a variety of lighting effects.

BACKGROUND

Lighting products, such as lamps or lights, for residential or commercial environments, are commonplace. Generally, lighting products are designed for use in either the residential or commercial environment, it is uncommon for lighting products to be designed for both environments.

Typically, there are different lighting products for particular purposes (e.g. ambient lighting versus accent lighting) or tasks within a given environment. For example, in the residential environment there are stand-up lamps (i.e. a lamp at the top of a pole), smaller lamps such as would be placed on a side table, desk lamps, fixtures, pendants, etc. While these can be purchased from the same source and thus look like an assorted set, these are often purchased at different times from different manufacturers and resulting in a collection of varied lighting styles.

Each piece of lighting is usually fixed in its physical and luminary properties—i.e. in its physical design and the character of the emitted light. Where there is variation, it tends to be limited to directing the light, or varying the intensity of the light (i.e. a lamp and bulb that can switch between low medium and high settings).

Often, the character of the emitted light is controlled through the use of a shade, which can soften or diffuse light, direct light, or even block the light in particular directions.

SUMMARY

The system and devices presented here are a variable modular lighting system that contains shade elements, light emitting devices and structural components. The shade elements are designed with specific intrinsic geometric relations such that they can interlink in various formations—i.e. the shade elements can be nested to one another so that one or more surfaces or adjacent shapes are flush with no gap in between. As long as the geometric relations are maintained the shade elements can be scaled to any size without losing their ability to interlink.

This results in a flexible lighting system, where the user can more easily adjust the system for various purposes than traditional lighting systems, whether making changes on a short term (i.e. changes throughout the day) or on a more long-term basis.

The shade elements may be constructed from non-rigid materials, such as paper, thin cardboard, plastic film, and similar materials of varying translucency. The light emitting devices discussed in this application are LEDs or light emitting diodes, although other light emitting devices can be used as long as they are compatible with the material of the shade elements. The light emitting devices can be configured to illuminate individual or multiple shades from within.

The structural components are designed to support individual or multiple shades in a variety of configurations. Some designs integrate the structural and lighting components into a single unit, resulting in fewer components (for ease of use) and less use of material.

In accordance with the present invention, there is provided a device comprising: a hollow box, wherein the box comprises: a central rectangular cuboid comprising a first edge, second edge and a third edge, where the first, second and third edges are perpendicular and meet at a first vertex and so define the cuboid in three dimensions, the central rectangular cuboid further comprising a fourth edge and a fifth edge, where the second edge and the fourth edge and the fifth edge are perpendicular and meet at a second vertex and the first edge and the fourth edge are parallel and approximately equal in length and the third edge and fifth edge are parallel and approximately equal in length, and the central rectangular cuboid further comprising four faces, where the first, second and fourth edge define the first face and the second, third and fifth edges define the second face; and the first and third edges do not define a face and the fourth and fifth edges do not define a face; and two opposed irregular triangular prism-shaped wings with the first irregular triangular prism-shaped wing attached to the first edge and the third edge of the central rectangular cuboid and having a sixth edge not attached to the central rectangular cuboid and defining the peak of the irregular triangle; and the second irregular triangular prism-shaped wing attached to the fourth edge and fifth edge of the central rectangular cuboid, and having a seventh edge not attached to the central rectangular cuboid and defining the peak of the irregular triangle.

In another aspect of the invention, the first, second and third edges are approximately equal in length, and the sixth edge and seventh edges are each approximately twice the length of the first edge. In another aspect, the first, second and third edges are equal in length, and the sixth edge and seventh edges are each twice the length of the first edge, within a manufacturing tolerance. In one embodiment, the manufacturing tolerance is +/−2 mm. In one embodiment, the manufacturing tolerance is +/−1 percent of the length of the third edge. In yet another aspect, the first, second and third edges are equal in length, and the sixth edge and seventh edges are each twice the length of the first edge.

In still another aspect of the invention, there is provided a plurality of devices, where each irregular triangular prism has a third face and a fourth face, and the devices are arranged so the faces of the wings of at least two of the devices abut. In another aspect, the central rectangular cuboid has a first hole on a face of the cuboid and a second hole the opposed face of the cuboid.

In another aspect of the invention, there is provided a device comprising a plurality of devices as described above, where the plurality of devices are arranged so that the plurality of holes form a tunnel.

In another aspect of the invention, there is provided a kit further comprising a structural element to support at least one device. In another aspect of the invention, the kit has a structural element comprising a base and a column extending therefrom.

In another aspect of the invention, the structural element incorporates at least one light emitting device. In another aspect of the invention, the device further comprises at least one light emitting device.

In a further aspect of the invention, the device can be collapsed and re-assembled.

In another aspect of the invention, the first hole contains a male electrical connection element and the second hole contains a female electrical connection element and when powered the female connection element powers at least one light emitting device and the male electrical connection element.

In another aspect of the invention, a plurality of devices are arranged so that the fourth edges of the plurality of devices form a continuous edge.

BRIEF DESCRIPTION OF THE DRAWINGS

In order to better understand various exemplary embodiments, reference is made to the accompanying drawings, wherein.

DETAILED DESCRIPTION

The system and devices presented here are a variable modular lighting system that contains shade elements, light emitting devices and structural components.

Figure 1:
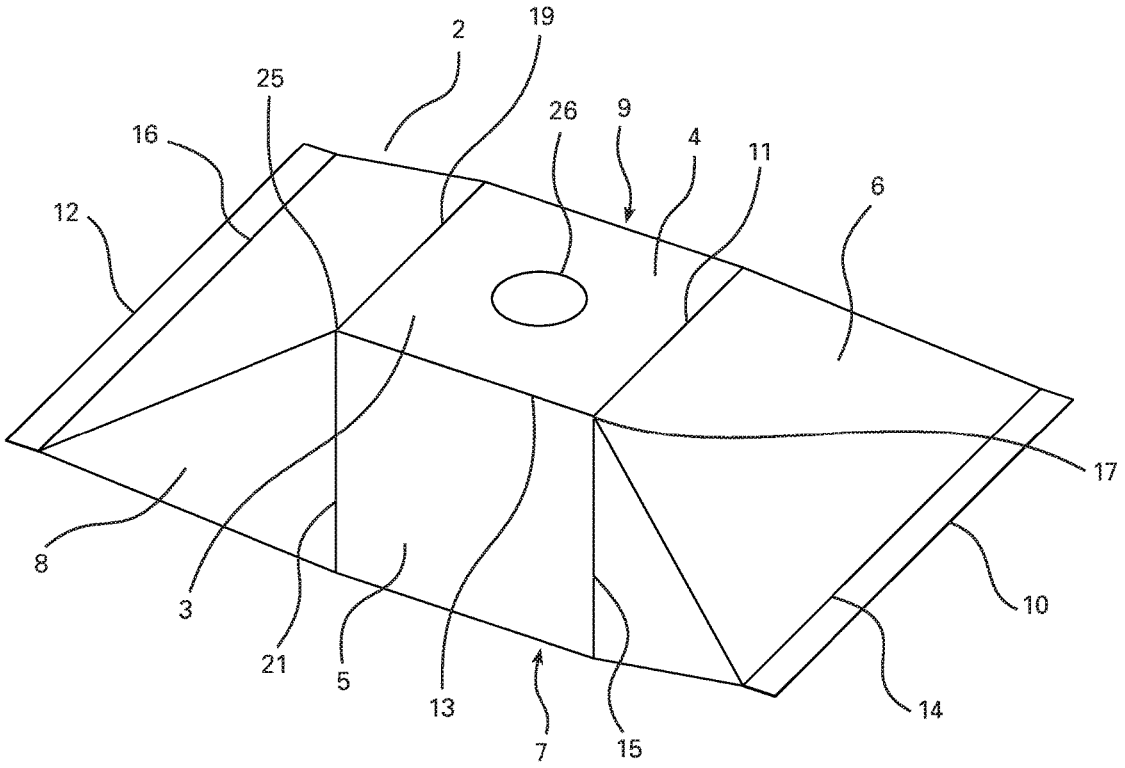
FIG. 1 is a perspective view of a typical shade element.

FIG. 1 is a perspective view of a typical shade element. Turning to FIG. 1, there is a shade element 2 that is hollow. It has a central rectangular cuboid portion 4, which is hollow and has four faces 3, 5, 7 and 9, and two wings 6 and 8 with edges 14 and 16 with optional connection strips 10 and 12. A rectangular cuboid is a cuboid where all angles are right angles and opposite faces are equal. Central rectangular cuboid 4 has edges 11, 13 and 15, which are perpendicular and meet at vertex 17 and so define the central rectangular cuboid portion 4 in three dimensions. Central rectangular cuboid 4 also has edges 19 and 21, where edges 19, 21 and 13 are perpendicular and meet at vertex 25. Edges 11, 13 and 19 define face 3 while edges 15, 13 and 21 define face 5.

Figure 2A:
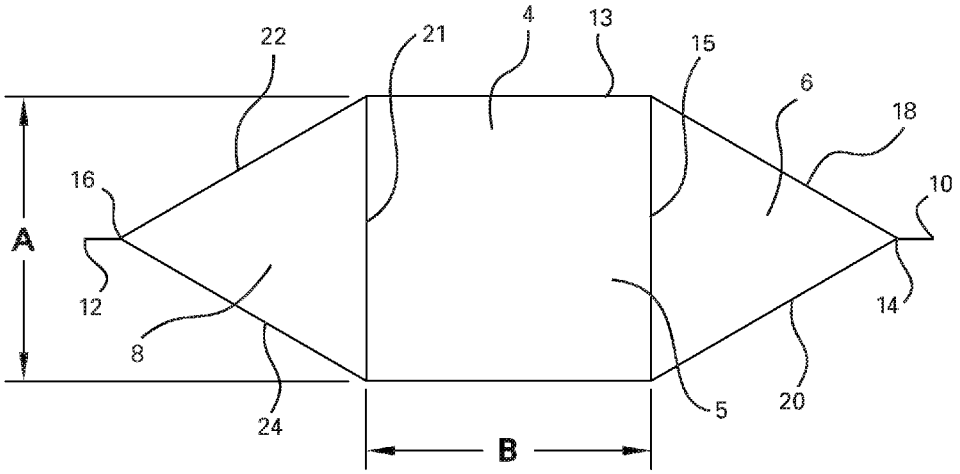
FIG. 2A shows is a side view of the shade element, illustrating the geometric relation.
Figure 2B:
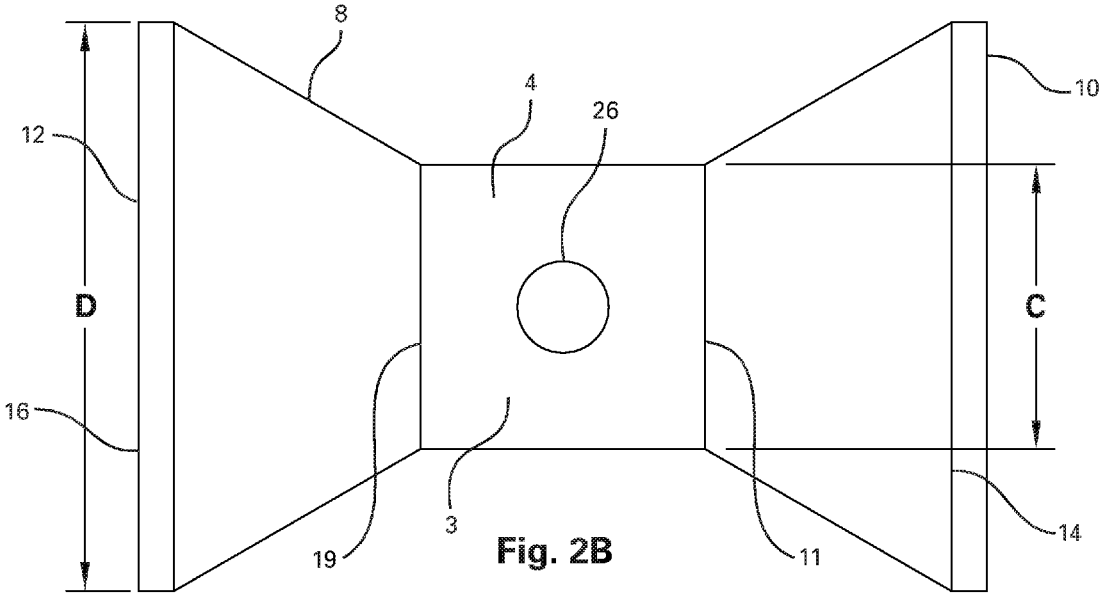
FIG. 2B shows is a top view of the shade element, illustrating the geometric relation.

A side view of this shade element is shown in FIG. 2A, and a top view is shown in FIG. 2B. Turning to FIG. 2A, central rectangular cuboid 4 has sides of length A (corresponding to edges 15 and 21) and B (corresponding to edge 13). Turning to FIG. 2B, the final side of central rectangular cuboid 4 has length C (corresponding to edges 11 and 19), and wings 6 and 8 have sides of length D (corresponding to edges 14 and 16).

The wings 6 and 8 are irregular triangular prisms, which means that the wings are triangular prisms (i.e. when seen from the side as in FIG. 2A, each wing appears as a triangle). Edges 14 and 16 thus define the peak of the irregular triangle. The length of edge 14 is usually different from the length of edge 11, although in a specific embodiment they may be equal. The length of edge 16 is usually different from the length of edge 19, although in a specific embodiment they may be equal. Wing 6 is attached to central rectangular cuboid 4 along the full length of edge 11 and full length of edge 15. Wing 8 is similarly attached to the opposing side of the central rectangular cuboid portion 4 along the full length of edges 19 and 21.

To allow the interlinking of the shade elements (as discussed below), length A=length B=length C=(length D divided by 2), which is the "geometric relation". In a practical embodiment, this relationship is approximate. At a minimum, this geometric relation is only maintained within the manufacturing error or margin of the method of manufacture. In one embodiment, the manufacturing tolerance is +/−2 mm. In another embodiment, the manufacturing tolerance is +/−1 percent of the length A. Also, in a physical embodiment the interlinking nature of the shade elements is maintained even if the geometric relation is only roughly maintained, so in alternative embodiments the geometric relation is length A being approximately equal to length B which is approximately equal to length C which is approximately equal to (length D divided by 2).

The shade elements are designed with this specific intrinsic geometric relation so that they can interlink in various formations. By interlink, it is meant that the shapes can be nested to each other in different orientations in a form-locking way, by making one or more surfaces of adjacent shapes flush. As long as the geometric relations are (approximately) maintained the shade elements can be scaled to any size without losing their ability to interlink.

Turning to the side view shown in FIG. 2A, wings 6 and 8 form (approximate) equilateral triangles seen from the side. For maximum interlinkability, and to allow the specific interlinking in FIG. 4, when seen from the side wings 6 and 8 need to form equilateral triangles.

In an alternative embodiment, wings 6 and 8 can be stretched by moving edges 14 and 16 of wings 6 and 8 perpendicularly away from central rectangular cuboid 4 to form isosceles triangles, so that the lengths of sides 18 and 20 are equal, and the lengths of sides 22 and 24 are equal. This alternative maintains a line of symmetry (through edges 14 and 16), but also changes the properties of the interlinking, so that while the specific example in FIG. 4 cannot be achieved using this alternative, different interlinkings are possible.

The connection strips 10 and 12 are optional, but may be included to allow the easier creation of permanent or detachable connections of the shade elements when interlinked, or if the shade elements are shipped flat the connection strips 10 and 12 may aid (as discussed below) in holding the shape of the shade elements in use. Connection strips 10 or 12 can be used to make connections using glue, two-sided tape, a hook and loop (Velcro™) system, or any other system for permanent or detachable attachment.

Figure 3A:
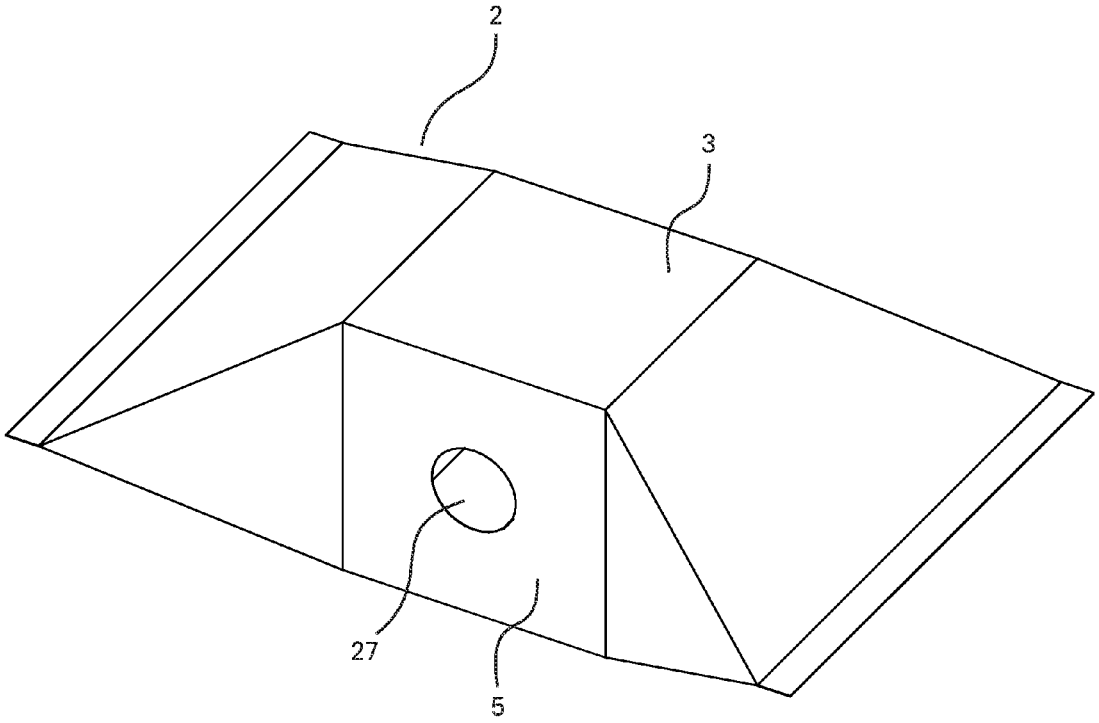
FIG. 3A is a perspective view of a typical shade element with a holes on opposing faces forming a tunnel perpendicular to the tunnel as shown in FIG. 1.
Figure 3B:
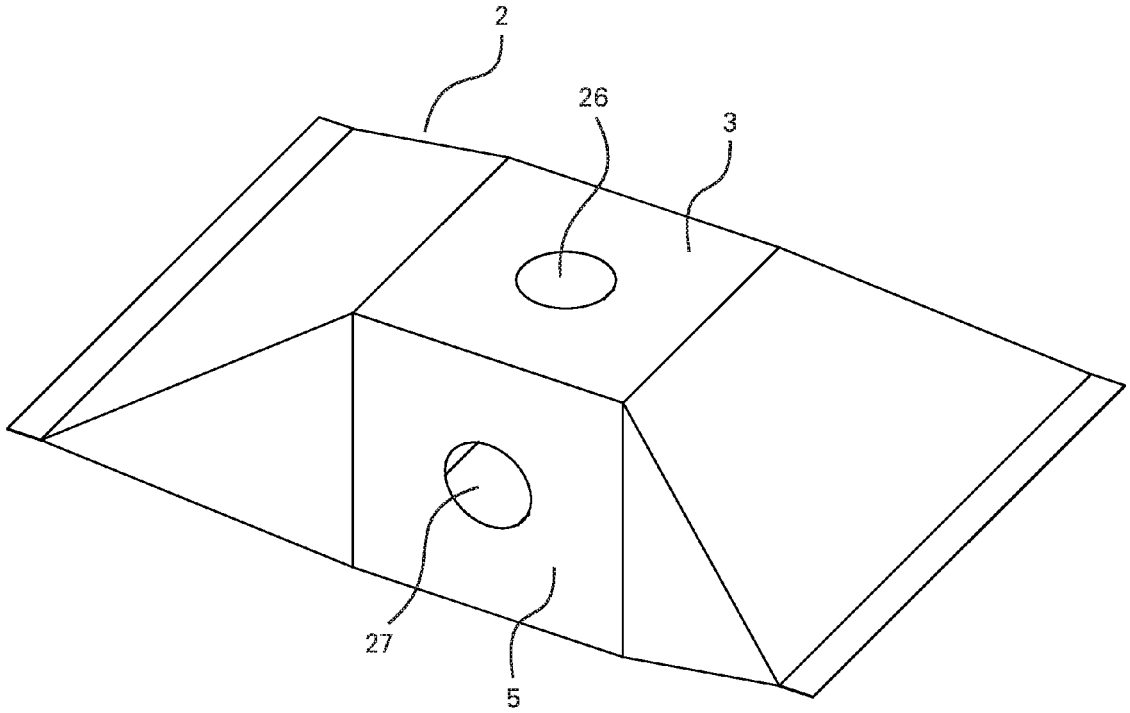
FIG. 3B is a perspective view of a typical shade element with two perpendicular tunnels.
Figure 4A:
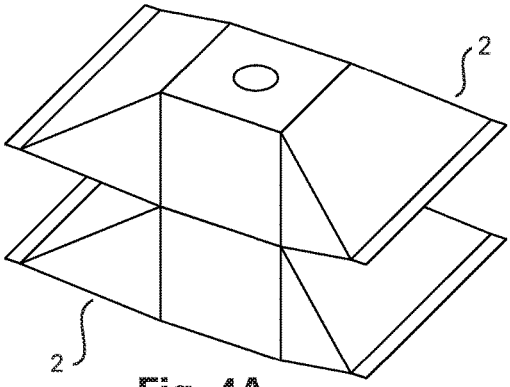
FIG. 4A-4E illustrates a variety of possible linkings of two shade elements in accord with the embodiment in FIGS. 1 and 3A.
Figure 4B:
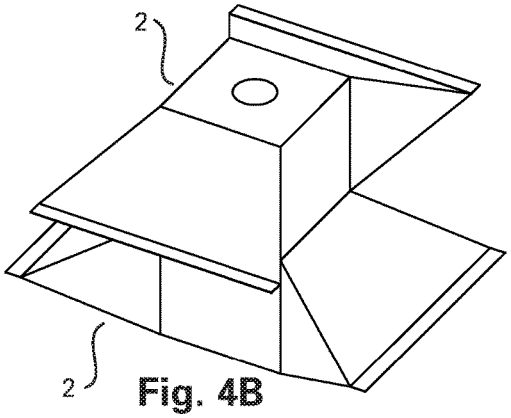
Figure 4C:
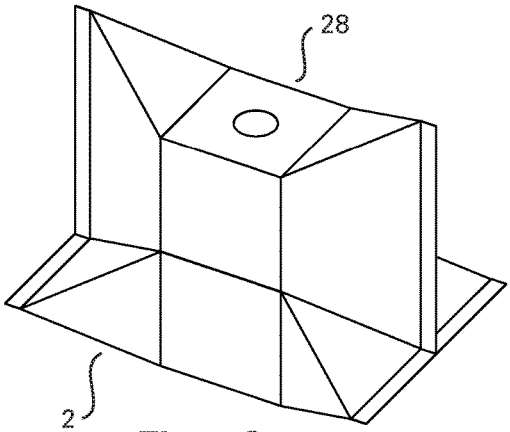
Figure 4D:
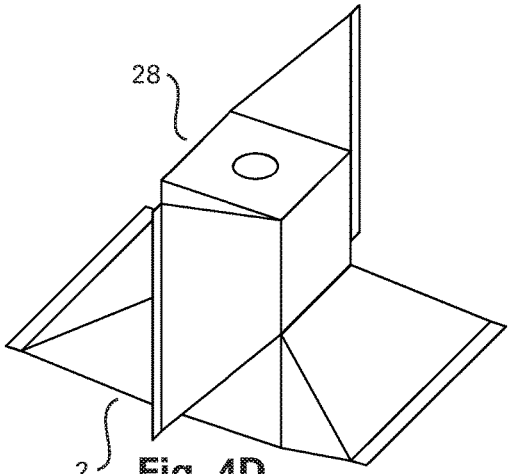
Figure 4E:
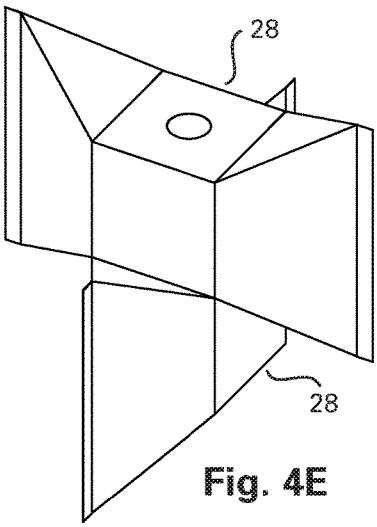

As illustrated in FIG. 2B, a hole 26 is pierced through face 3 of central portion 4 of shade element 2. A second hole is located on face 7 of the central rectangular cuboid portion 4. In other words (recalling that shade element 2 is hollow), holes are pierced in opposing faces of central portion 4 created a tunnel or path through which a columnar support or rod may be passed. As illustrated, the holes are oriented so that the "tunnel" is approximately perpendicular to surface 3 (in FIG. 2B) and is located in the centre of surface 3. Alternatively, a tunnel may be made through the central portion 4 in any direction. In an exemplary embodiment, the tunnel may be oriented as illustrated in FIG. 2B or lie in a perpendicular right angle as illustrated by shade element 28 in FIG. 3—oriented so that hole 27 and the hole on the opposing face of central portion 4 from a "tunnel" that is approximately perpendicular to surface 5 and is located in the centre of surface 5. For further interlinkability, two holes 26 and 27 (as described above) and corresponding holes on the opposing faces may be present, as illustrated in FIG. 3B.

As may be seen in FIGS. 4A through 4E, two of shade elements 2 and/or 28 may be interlinked in several ways while lining up the "tunnels" of shade elements 2 and/or 28.

Figure 5:
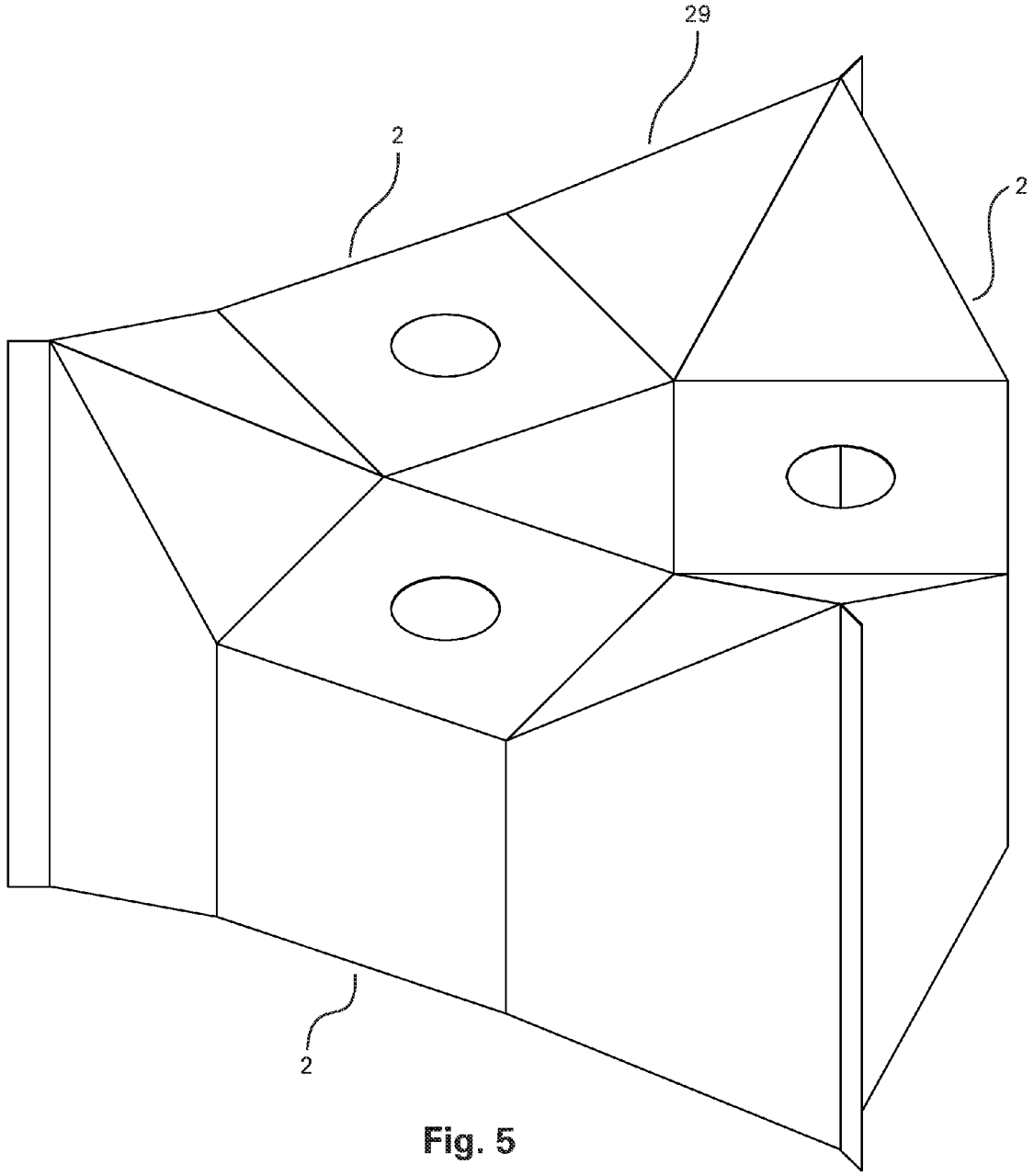
FIG. 5 illustrates a combination of three shade elements into a larger triangular module.

As illustrated in FIG. 5, three shade elements may be interlinked by abutting the surfaces or faces of their wing portions to form a triangular module 29. These are illustrated with shade elements 2, but could also use 1 to 3 shade elements 28 as desired.

Figure 6A:
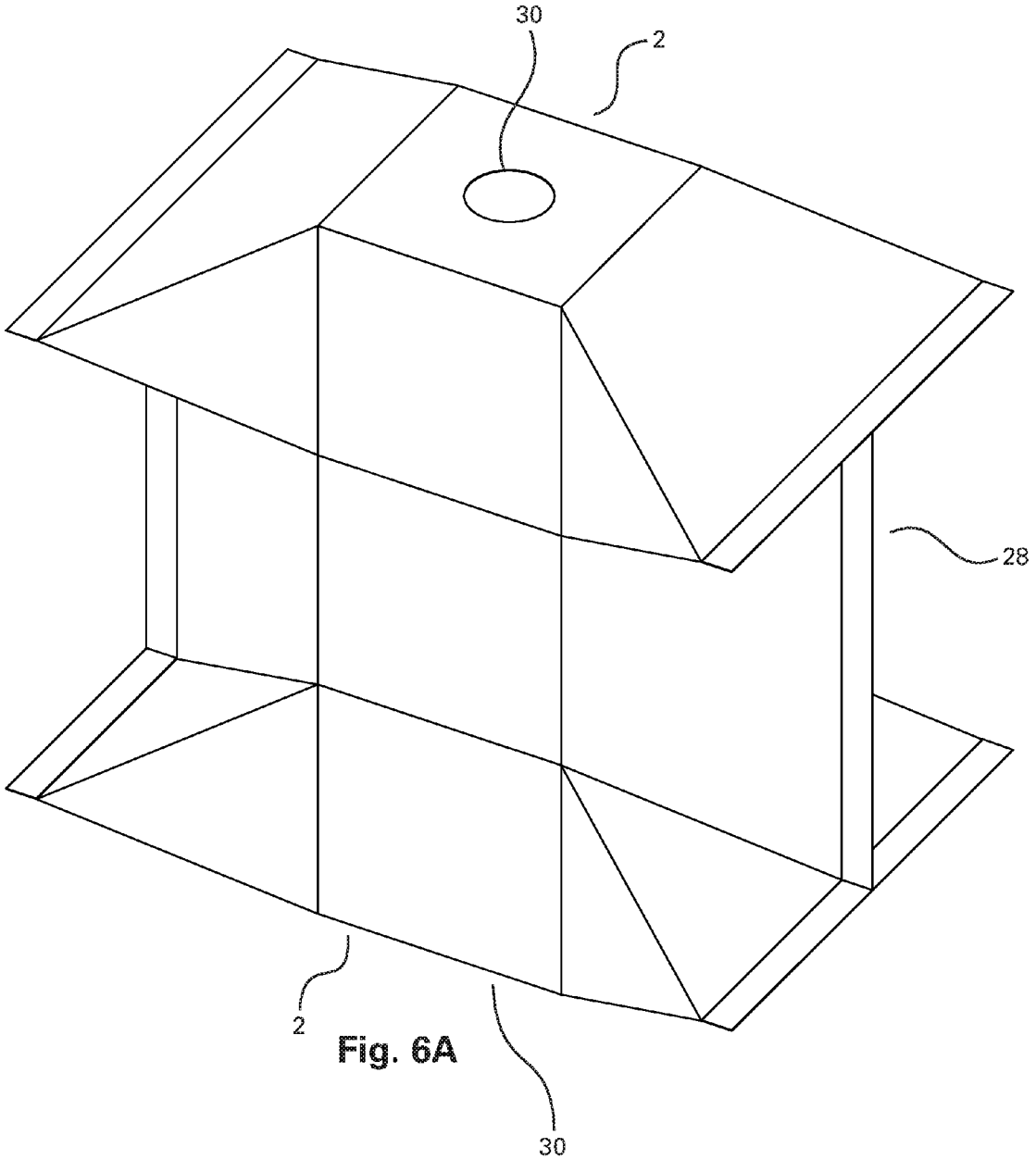
FIG. 6A illustrates a combination of three shade elements into a larger octagonal shape.
Figure 6B:
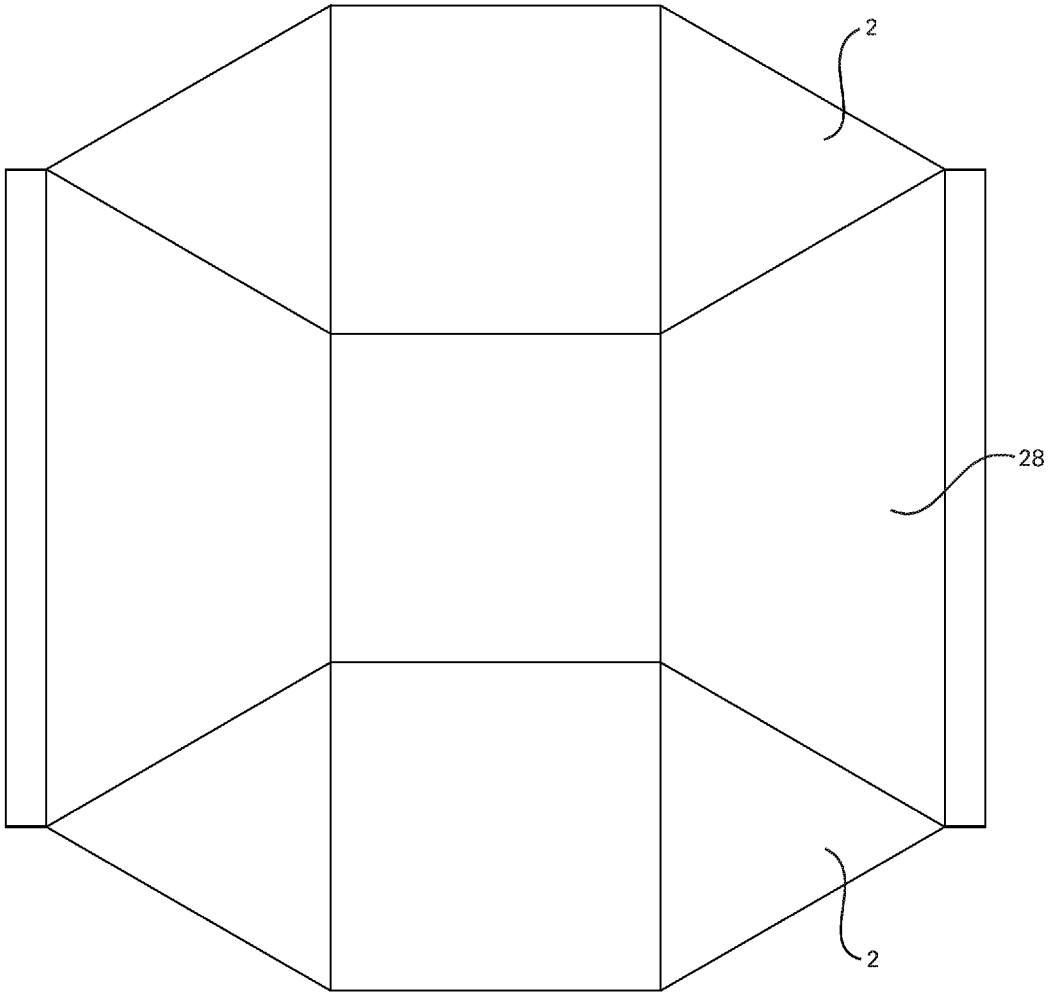
FIG. 6B illustrates a side view of the combination of three shade elements into a larger octagonal shape of FIG. 6A.

As shown in FIGS. 6A and 6B, three shade elements may be interlinked to form a larger octagonal shape. Note that by using shade elements 2 and 28 as illustrated, the holes line up to form a continuous "tunnel" 30.

Figure 7:
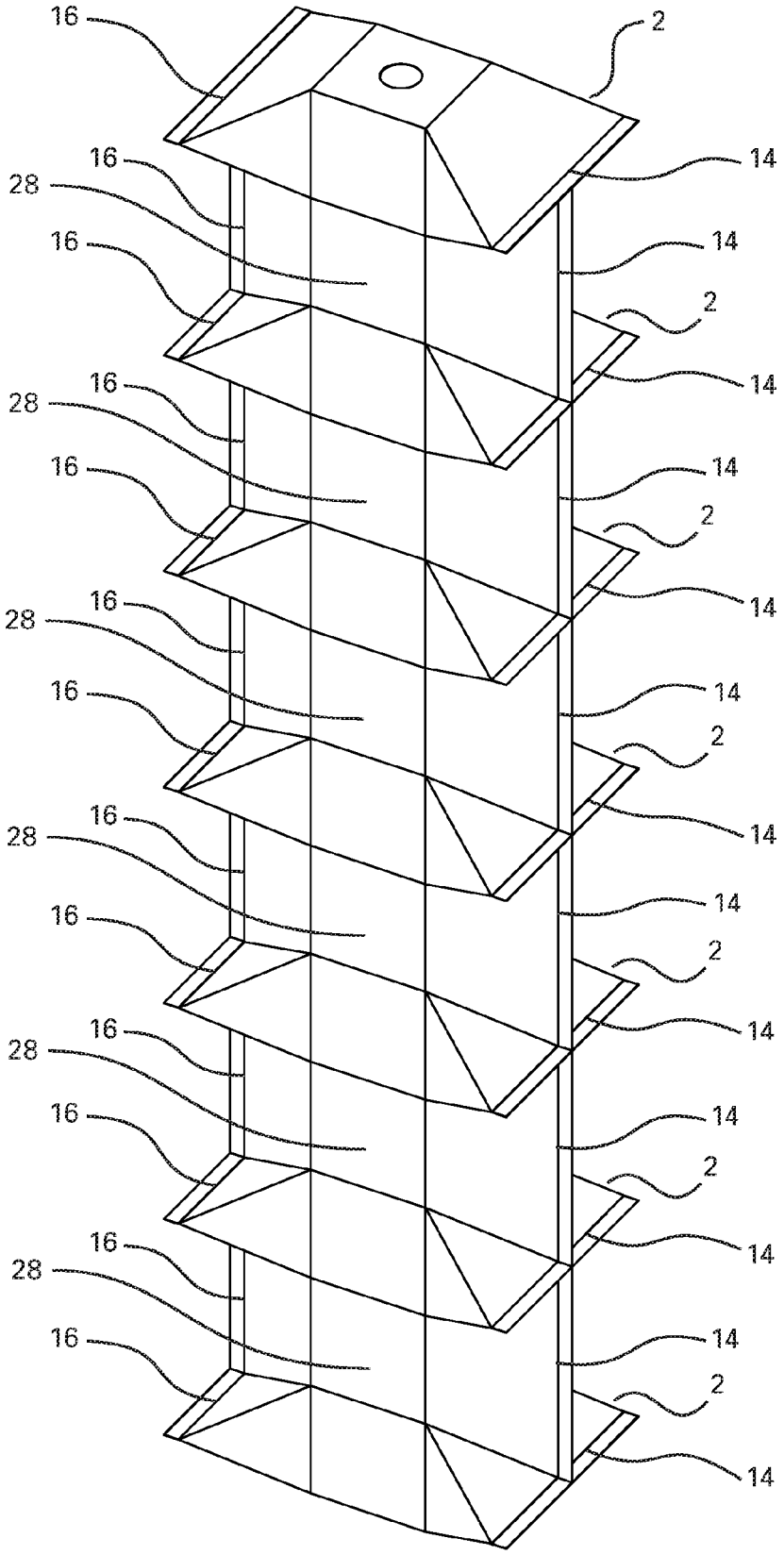
FIG. 7 illustrates a stacking of multiple shade elements into a larger linear assembly.
Figure 8:
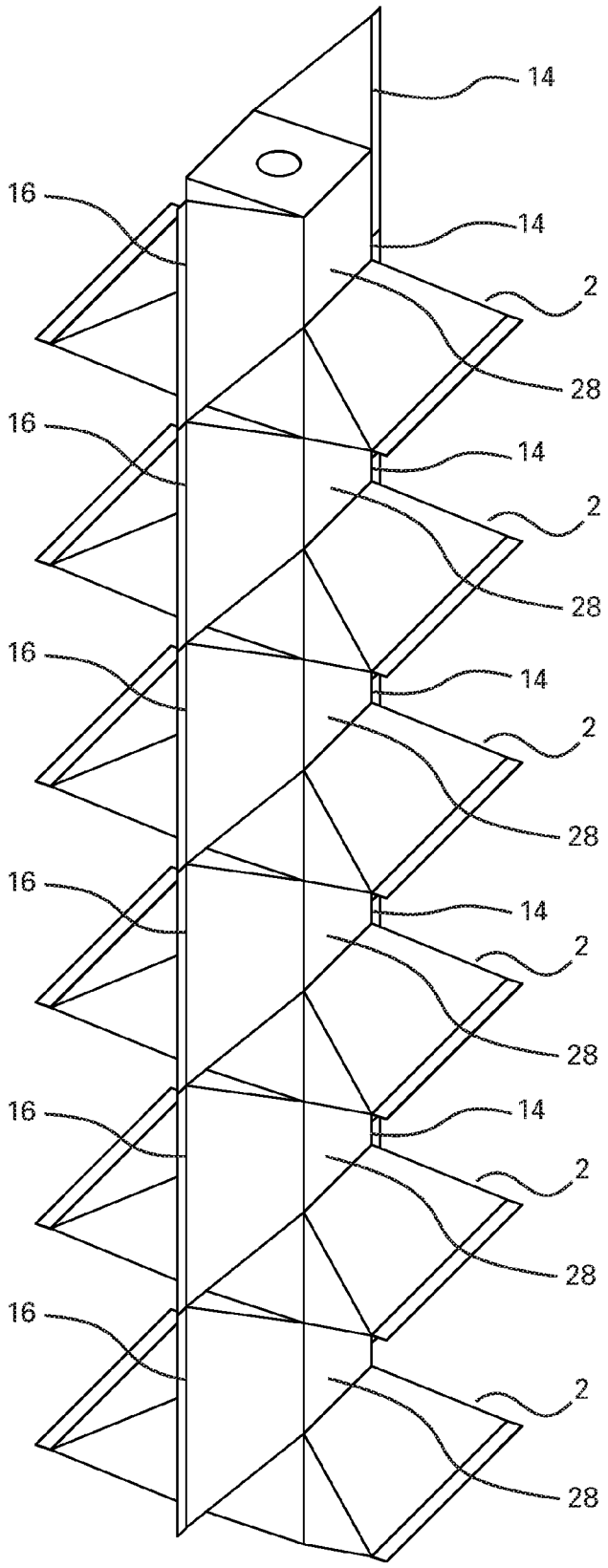
FIG. 8 illustrates a stacking of multiple shade elements into an alternative larger linear assembly.
Figure 9:
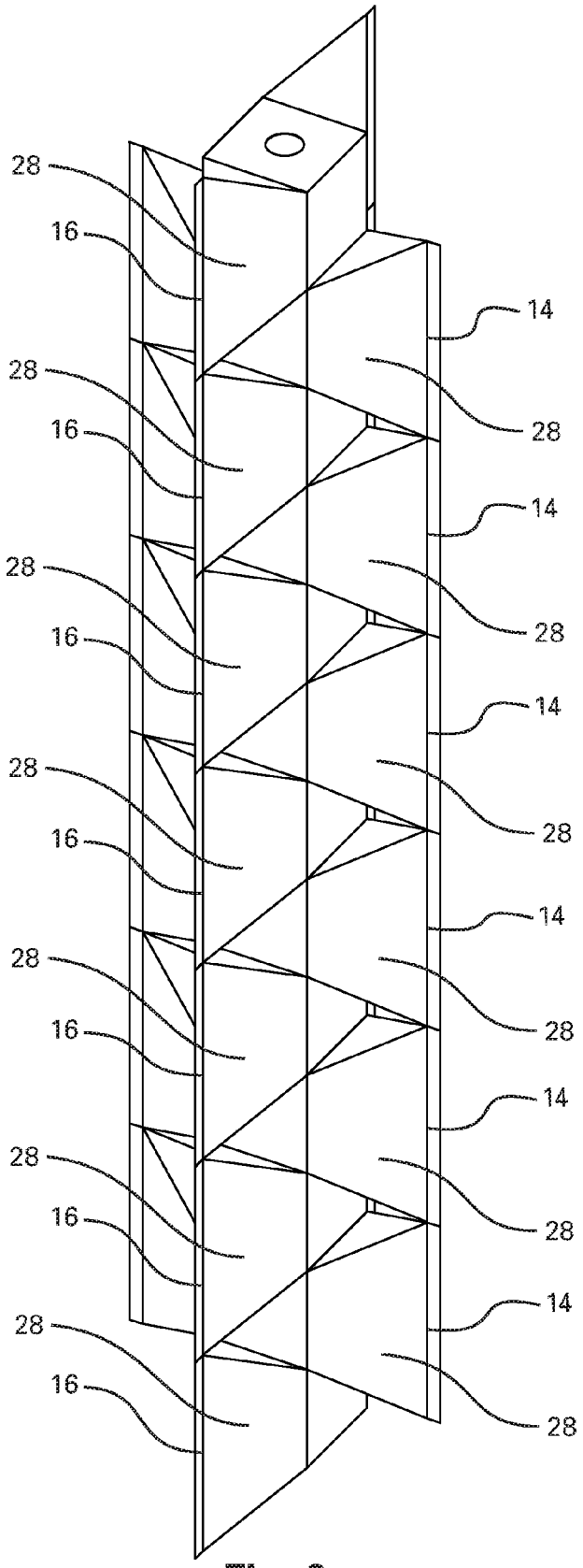
FIG. 9 illustrates a stacking of multiple shade elements into another alternative larger linear assembly.

Shade elements 2 and 28 may be interlinked in a stack while maintaining a continuous tunnel in numerous patterns, creating a variety of different lights as illustrated in FIGS. 7-9.

In an exemplary embodiment, due to the geometric relation, edges 14 and 16 of the shade elements 2 and 28 form a continuous edge in the specific interlinks illustrated in FIGS. 7-9.

Through use of the interlinks available through use of the geometric relation, formations can also be achieved that undulate into three dimensions. Furthermore, in FIGS. 7-9 the continuous tunnel can be oriented in any direction in space, not just in a vertical perpendicular to the ground.

Figure 10:
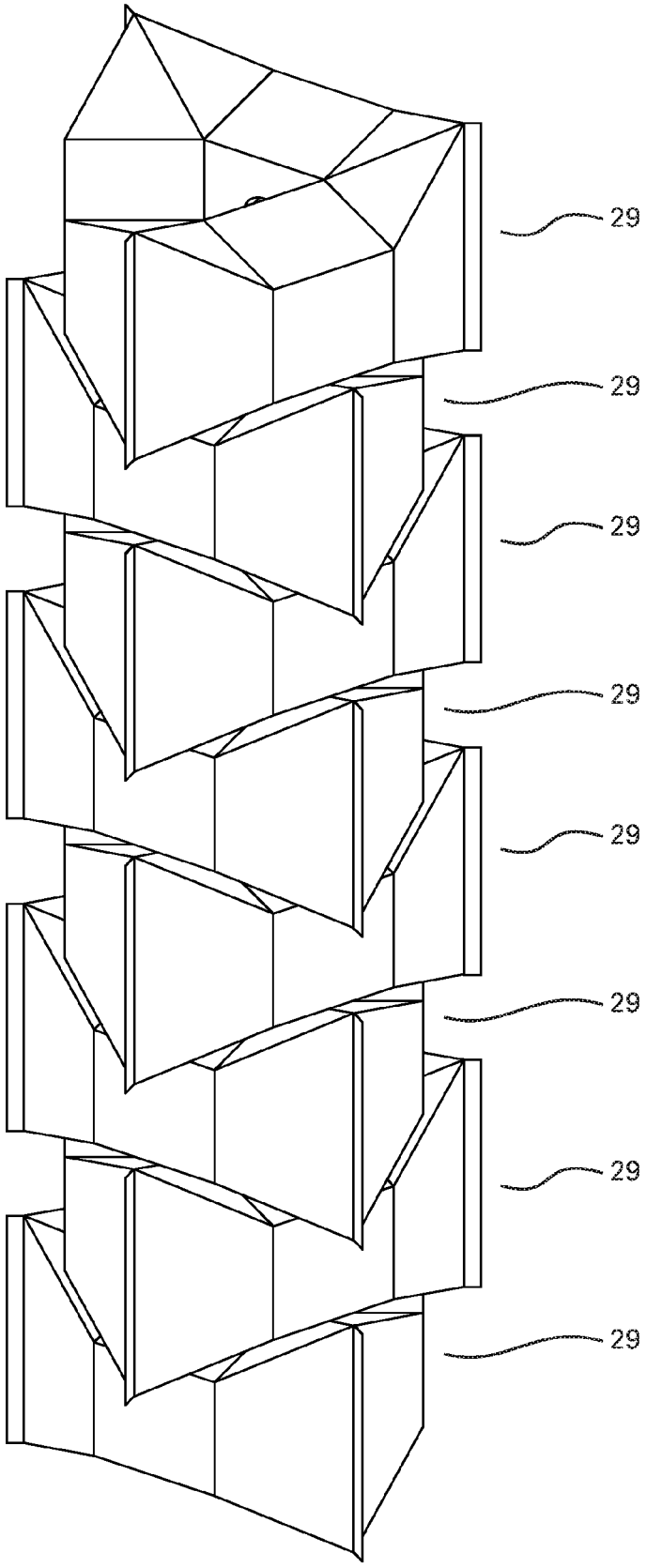
FIG. 10 illustrates a stacking of the shade elements of FIG. 4, resulting in a larger linear configuration.
Figure 11:
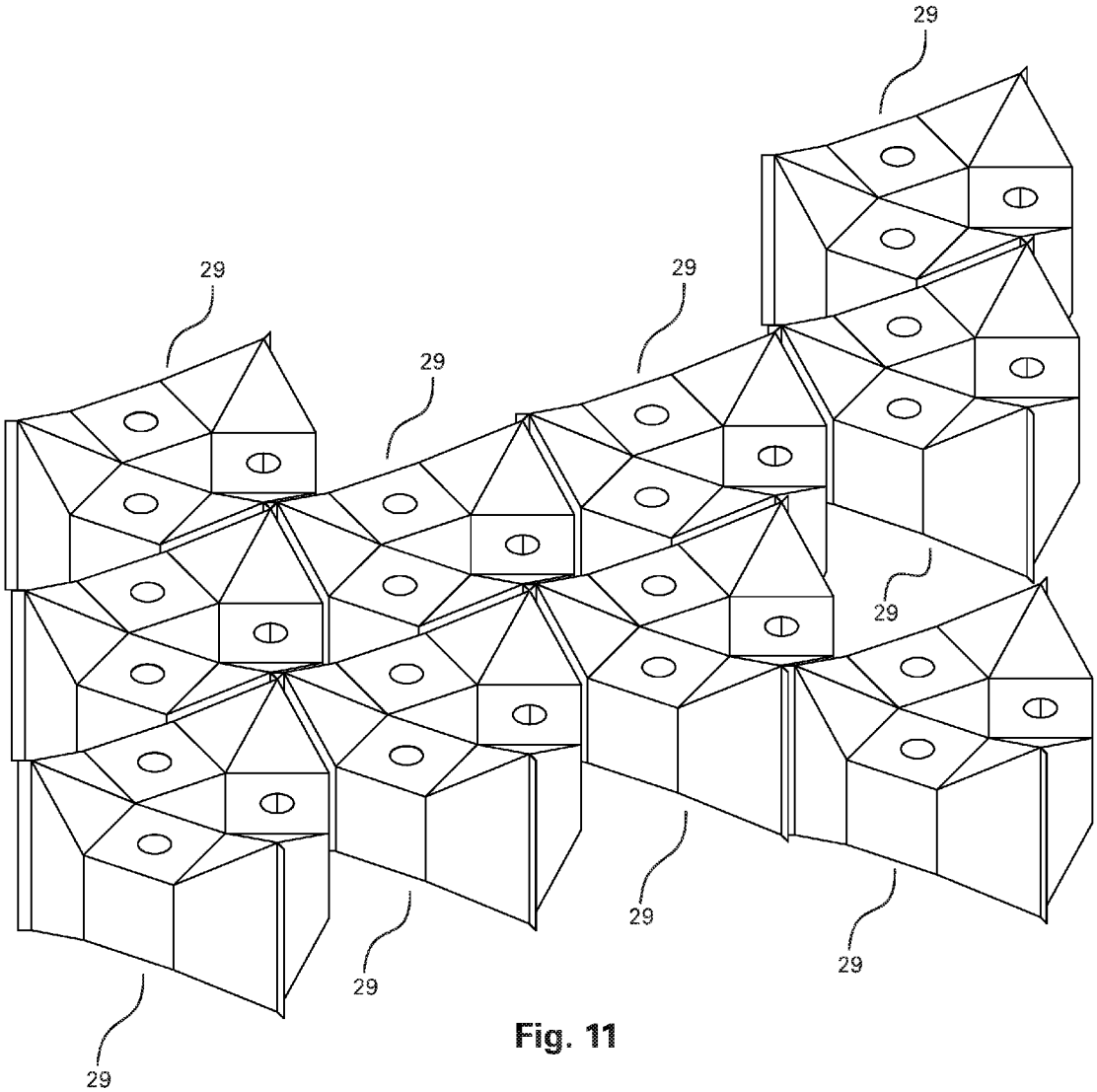
FIG. 11 shows a combination of the shade elements of FIG. 4 into a continuous hexagonical spatial pattern.

For example, the triangular modules 29 depicted in FIG. 5 can be interlinked in a stack to create the larger linear configuration seen in FIG. 10. Alternatively, triangular modules 29 (as depicted in FIG. 5) can be interlinked into a continuous hexagonal pattern as seen in FIG. 11.

As may be seen in the Figures as discussed above, the use of the geometric relation for the shade element allows for interlinking to create many different forms of lighting shapes.

Figure 12A:
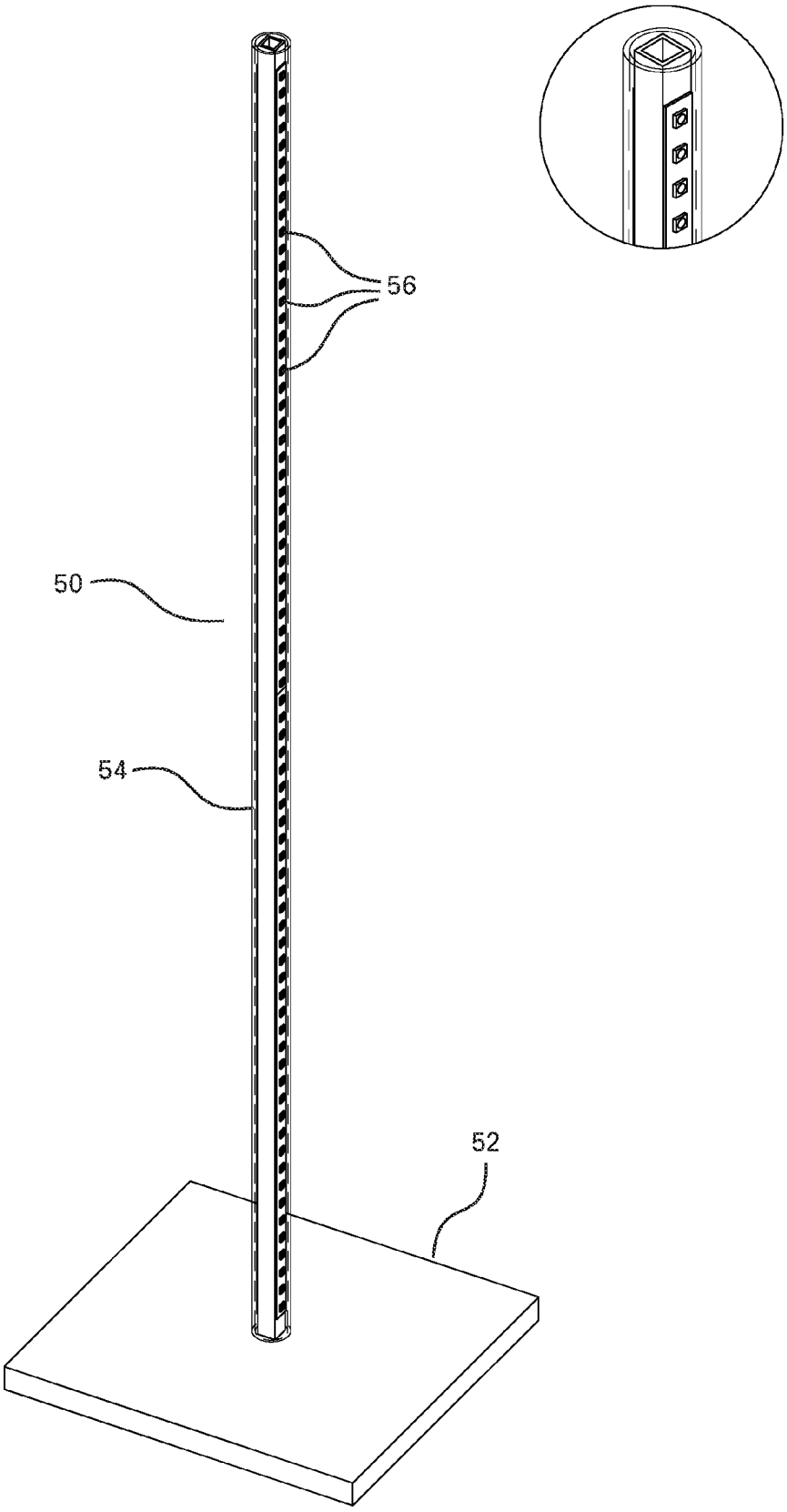
FIG. 12A shows a columnar structural component that can guide and hold shade elements in place.
Figure 12B:
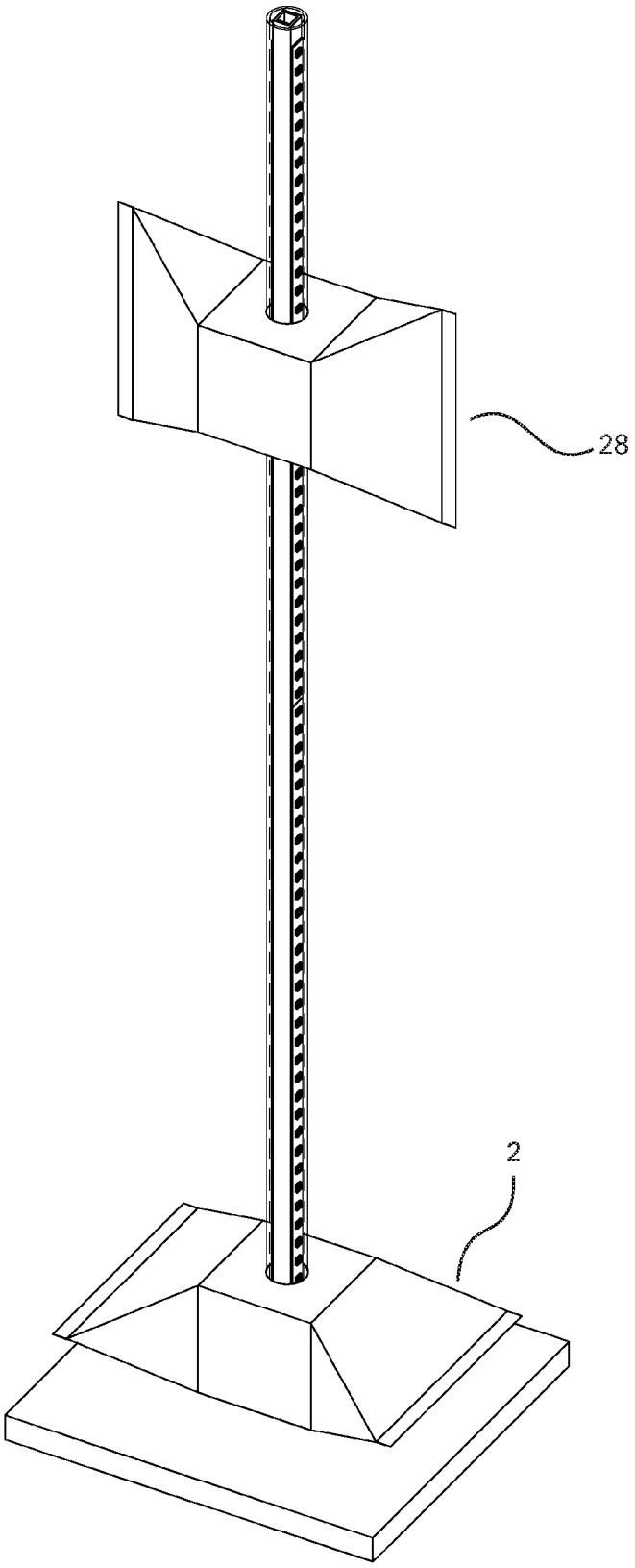
FIG. 12B shows the columnar structural component of FIG. 12A in use with two shade elements.

The interlinked shade elements illustrated in the Figures discussed above are complemented by a variety of structural components and/or light emitting devices. For example, the interlinked configurations illustrated in FIGS. 6-9 create a "tunnel" that can be supported by a central column containing light emitting devices onto which the shade elements are slide from above. Turning to FIGS. 12A and 12B, structural element 50 has a base 52, a column 54 and light emitting devices 56. Generally, light emitting devices 56 are light emitting diodes (LEDs), although any sort of lighting may be used which is physically compatible with the shade elements. Turning to FIG. 12B, a shade element 2 has already been slid onto column 52, and a second shade element 28 is in the process of being slid on. The interlinked elements of FIGS. 6-9 may all be created and supported using structural element 50 from FIGS. 12A and 12B.

Figure 13:
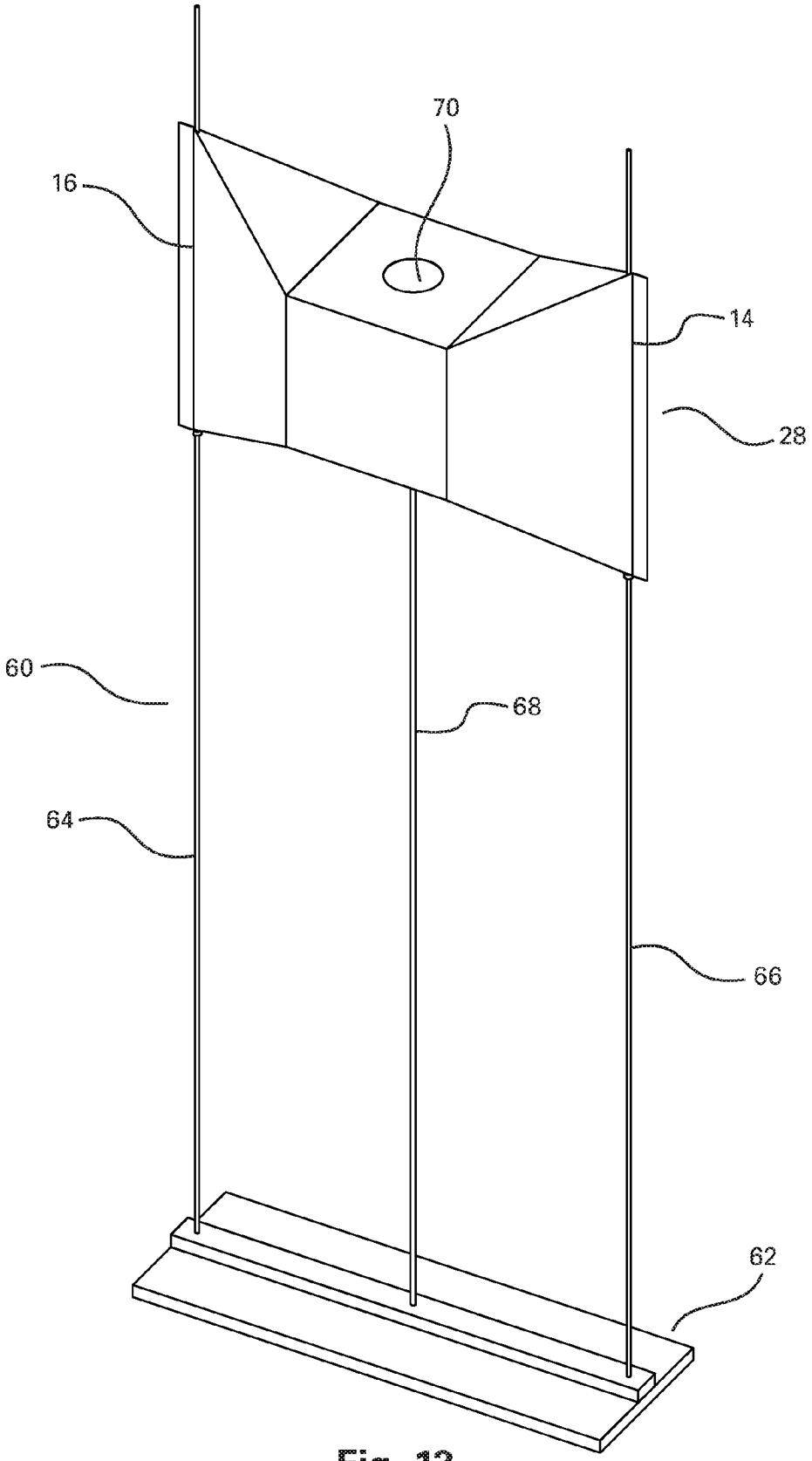
FIG. 13 shows another structural component that can guide and hold shade elements in place.

A different structural element is illustrated in FIG. 13. Turning to FIG. 13, structural element 60 has a base 62 from which two columns 64 and 66 extend and attach to shade element 28 at edges 14 and 16. A tube 68 also extends upwards and into tunnel 70 and supports a light emitting device (not illustrated) inside of tunnel 70.

A wide variety of lighting effects can be achieved by varying the configuration of the interlink between shade elements.

A wide variety of lighting effects can also be achieved by varying the materials from which the shade elements are constructed. By varying the translucency and/or colour of the materials of different parts of a shade element, light may be directed (in some cases, a mirror in the interior of the shade element may be used), softened, diffused, or coloured.

In cases where the shade elements are not permanently attached (i.e. are detachably attached or simply resting on a central column), shade elements may be swapped out by the user to achieve different lighting effects. For example, when working at a desk, a columnar structural element as seen in FIG. 13 may be used with shade elements that allow bright light from the light emitting elements, or in a more sophisticated design direct light to an accented spot (for example, a working area, similar to a desk lamp). If the room is then to be used for entertaining, shade elements may be substituted that diffuse and soften the light, creating atmospheric ambient lighting. In another example, in a sales office, a columnar structural element as seen in FIG. 13 may be used with shade elements in a first particular client's corporate colours, and then next month switched for a second client's corporate colours.

The shade elements are constructed from nonrigid materials such as paper, thin cardboard, plastic film and similar materials of varying translucency. The materials do require a certain stiffness to weight ratio and weight-wise can go up to the equivalent of a light cardboard. A slight cotton content is possible. HDPE and PVC are potential material options. PVC, however, is environmentally less preferable. Other possibilities are a polyester film such as Mylar™ or polyethylene film such as Tyvek™.

Figure 14:
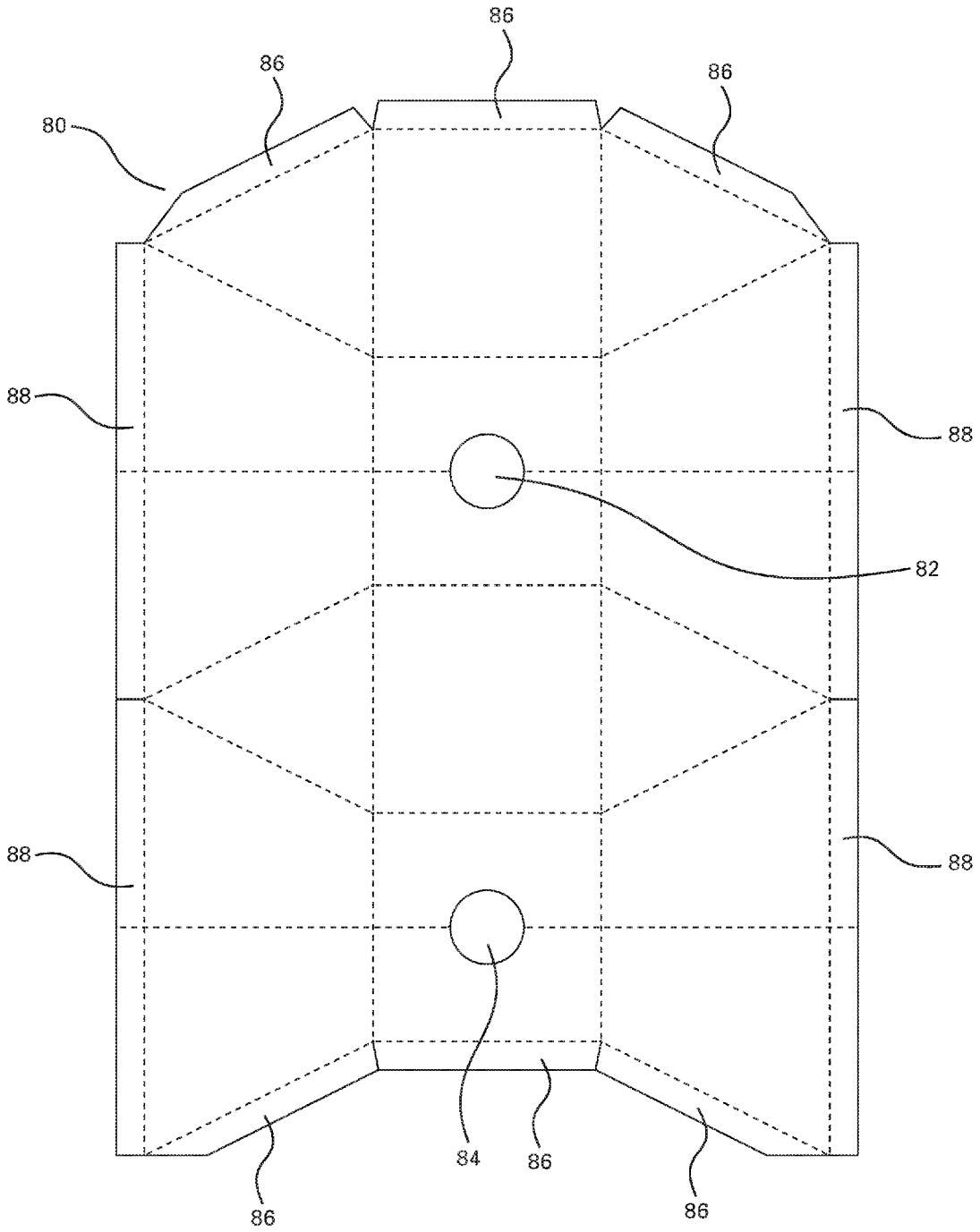
FIG. 14 shows a light shade collapsed flat.

The shade elements may be designed to be shipped flat and folded into shape before use. Turning to FIG. 14, shade element 80 is a flat piece of material with holes 82 and 84 (which when shade element 80 is assembled form a tunnel), and fold lines as illustrated be dotted lines. By folding along the dotted lines, a shade element 2 (as seen in FIG. 1) may be assembled. In an alternative embodiment, holes 82 and 84 are indicated in the shade element as shipped and are punched out before folding.

Connection strips 86 are optional, but preferred, when used to ensure that the shade element retains its shape once folded into shape. Connection strips 86 may create permanent or detachable connections, and may make connections using glue, two-sided tape, a hook and loop (Velcro™) system, or any other system for permanent or detachable attachment.

Connection strips 88 are also optional but preferred, and may also be used to ensure that the shade element retains its shape once folded into shape. In an exemplary embodiment, connection strips 88 may also be used to connect interlinked shade elements. Connection strips 88 may create permanent or detachable connections, and may make connections using glue, two-sided tape, a hook and loop (Velcro™) system, or any other system for permanent or detachable attachment.

Optionally, a mirror may be placed on one of the inside surfaces of the shade element to direct light.

The light emitting devices discussed in this application are LEDs or light emitting diodes, although other light emitting devices can be used as long as they are compatible with the material of the shade elements. The light emitting devices can be configured to illuminate individual or multiple shades from within.

The structural components are designed to support individual or multiple shades in a variety of configurations. In an alternative set of embodiments, the structural and lighting components may be integrated into a single unit, resulting in fewer components (for ease of use) and less use of material.

In an alternative set of embodiments, lighting components (and associated electronics) are integrated into a shade element. This would work best with a rigid shade element, such as a shade element made of blow-molded plastic. Each shade element may have an independent source of power (whether batteries or a cord and plug), or in another embodiment a structural element may be used to deliver power to the shade elements.

Figure 15:
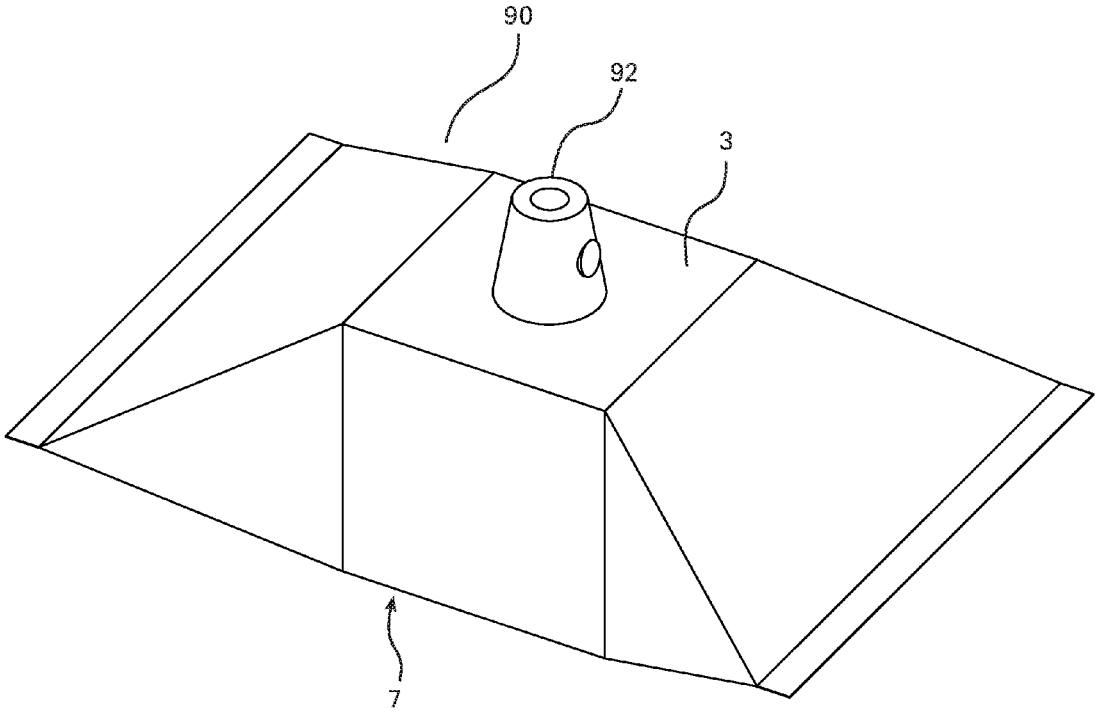
FIG. 15 shows a light shade with a male electrical connector.

FIG. 15 illustrates one such embodiment. Turning to FIG. 15, shade element 90 is generally similar to shade element 2. In place of hole 26 in shade element 2, there is a male electronics element 92 that extends perpendicular to face 3. On opposing face 7 in place of a hole is a corresponding female electronic element. The electronic elements are configured so that if power is supplied to the female electronic element, it is also supplied to the male electronic element 92 and, if there is a lighting element in shade element 90 it will also supply power to this lighting element.

Figure 16:
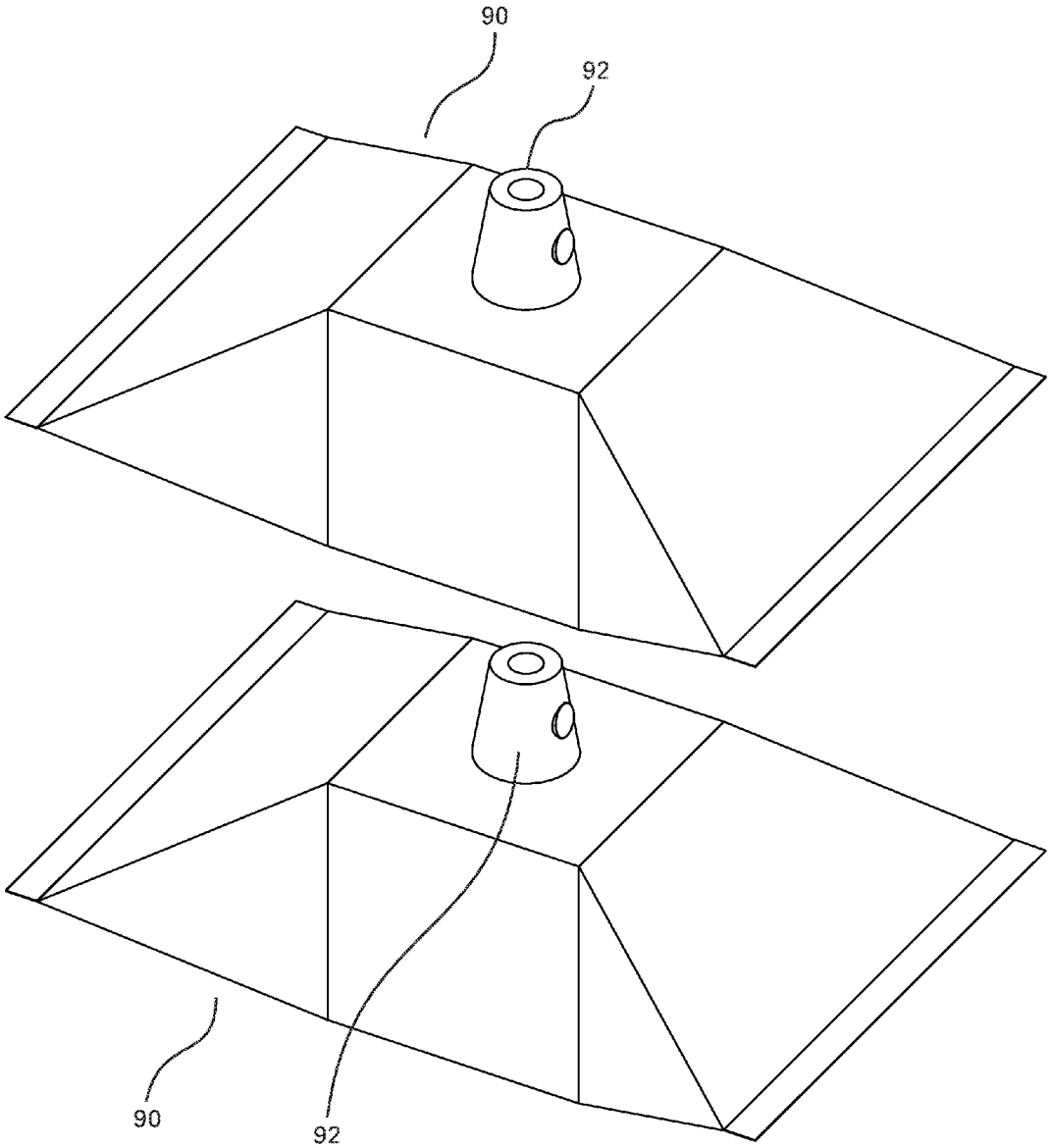
FIG. 16 shows two light shades with male and female electrical connectors.
Figure 17:
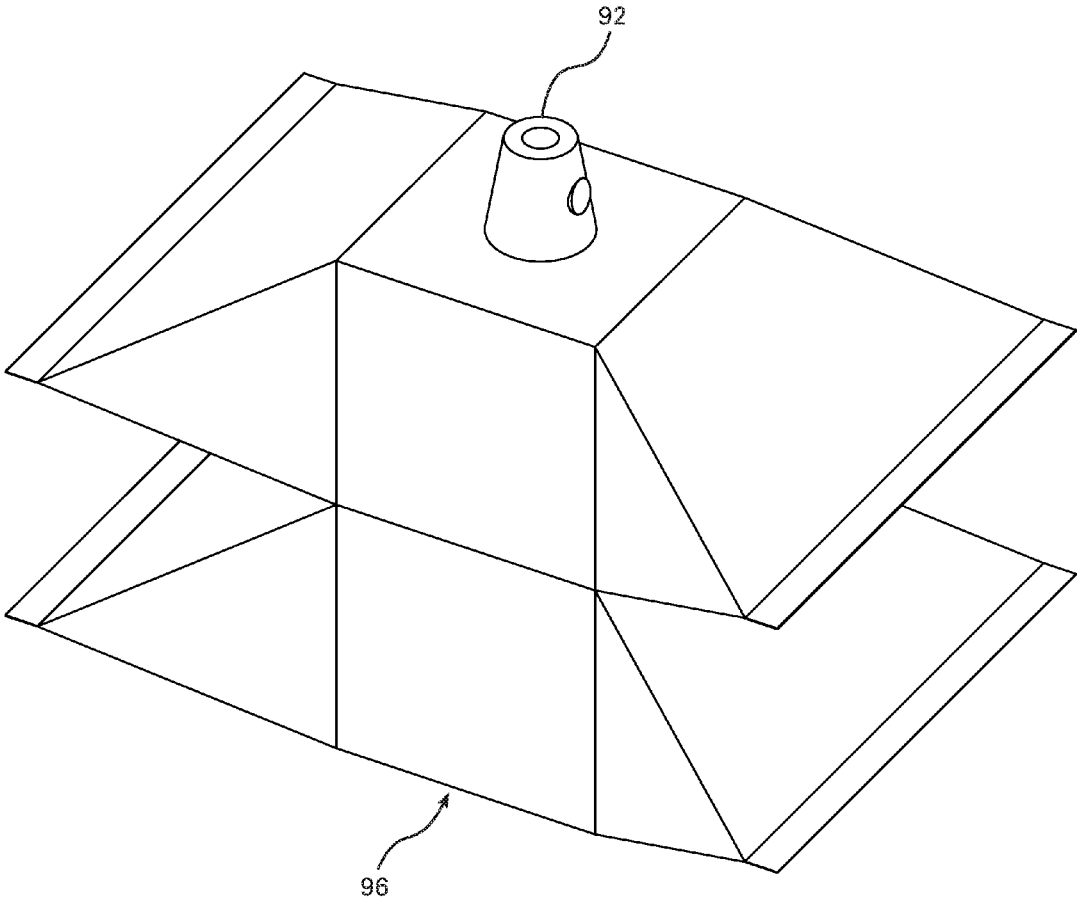
FIG. 17 shows the two light shades of FIG. 16 connected.

As a result, multiple shade elements 90 can be connected or stacked to transmit power through the stack, and power any light elements connected to the stack. Turning to FIG. 16, there are shown two shade elements 90 ready for connection. Turning to FIG. 17, the two shade elements 90 are connected by connecting the male and female connectors of the two shade elements. As a result, supplying power to female element 96 (for example, through a cord or a battery) will power male electronic element 92.

Figure 18:
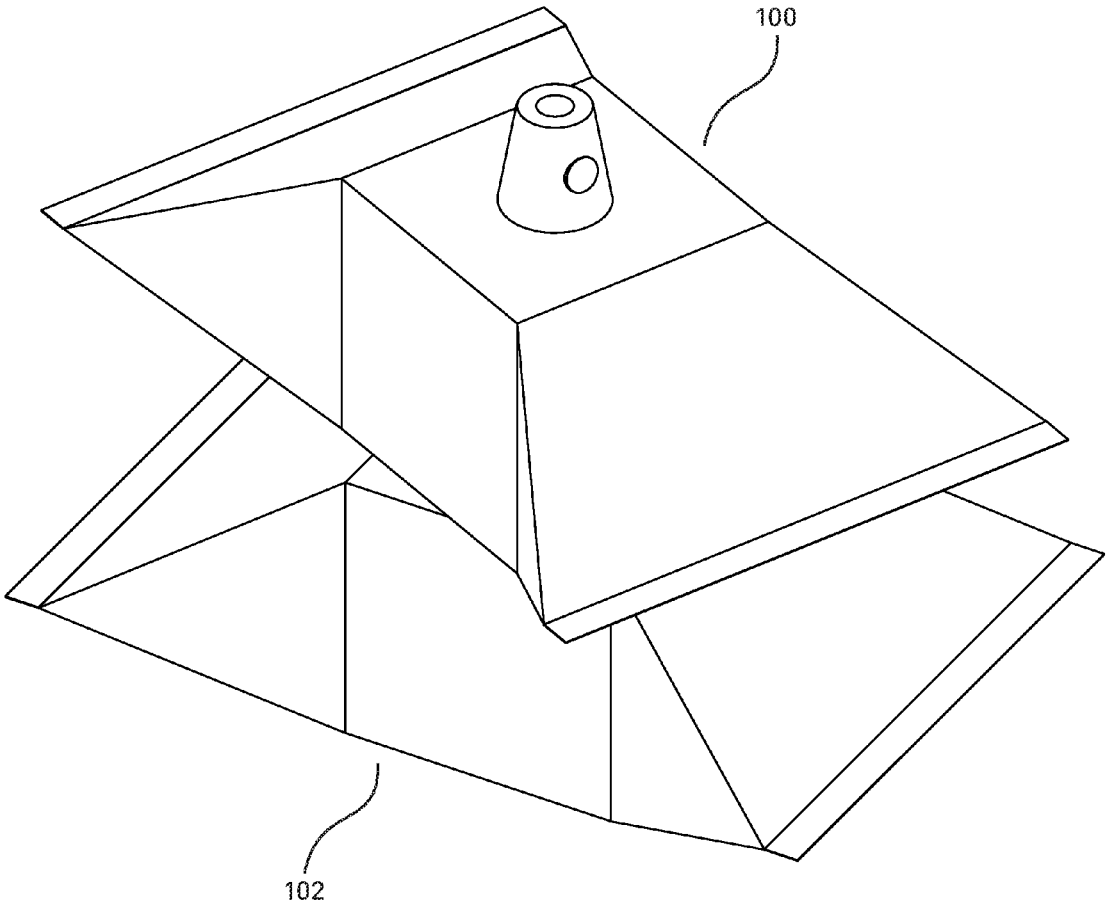
FIG. 18 shows the two light shades of FIG. 17 connected and with one light shade rotated relative to the other light shade.

In a further embodiment, the male and female elements are pivotable, so that the shade elements can be rotated. Turning to FIG. 18, shade element 100 has been rotated relative to shade element 102.

The invention is not intended to be limited to the embodiments described herein, but rather the invention is intended to be applied widely within the scope of the inventive concept as defined in the specification as a whole including the appended claims.

What is claimed is:

1. A device comprising:

a hollow box, wherein the box comprises:

a central rectangular cuboid comprising a first edge, second edge and a third edge, where the first, second and third edges are perpendicular and meet at a first vertex and so define the cuboid in three dimensions, the central rectangular cuboid further comprising a fourth edge and a fifth edge, where the second edge and the fourth edge and the fifth edge are perpendicular and meet at a second vertex and the first edge and the fourth edge are parallel and approximately equal in length and the third edge and fifth edge are parallel and approximately equal in length, and the central rectangular cuboid further comprising four faces, where the first, second and fourth edge define the first face and the second, third and fifth edges define the second face; and the first and third edges do not define a face and the fourth and fifth edges do not define a face; and two opposed irregular triangular prism-shaped wings with a first irregular triangular prism-shaped wing attached to the first edge and the third edge of the central rectangular cuboid and having a sixth edge not attached to the central rectangular cuboid and defining the peak of the first irregular triangle; and a second irregular triangular prism-shaped wing attached to the fourth edge and fifth edge of the central rectangular cuboid, and having a seventh edge not attached to the central rectangular cuboid and defining the peak of the second irregular triangle.

2. The device of claim 1, where the first, second and third edges are approximately equal in length, and the sixth edge and seventh edges are each approximately twice the length of the first edge.

3. The device of claim 1, where the first, second and third edges are equal in length, and the sixth edge and seventh edges are each twice the length of the first edge.

4. A device comprising a plurality of devices of claim 2, where each irregular triangular prism has a third face and a fourth face, and the devices are arranged so the faces of the wings of at least two of the devices abut.

5. The device of claim 1, where the central rectangular cuboid has a first hole on a face of the cuboid and a second hole on an opposed face of the cuboid.

6. A plurality of devices of claim 5, wherein the devices are arranged so that the holes form a tunnel.

7. A kit comprising at least one device of claim 5, and a structural element to support the at least one device of claim 5.

8. The kit of claim 7, where the structural element comprises a base and a column extending therefrom.

9. A kit of claim 8, wherein the structural element incorporates at least one light emitting device.

10. A device of claim 5, further comprising at least one light emitting device.

11. A device of claim 5, that can be collapsed and re-assembled.

12. A device of claim 5, wherein the first hole contains a male electrical connection element and the second hole contains a female electrical connection element and when powered the female connection element powers the at least one light emitting device and the male electrical connection element.

13. A plurality of devices of claim 2, arranged so that the sixth and seventh edges of the plurality of devices form a continuous edge.

* * * * *